US006906627B1

(12) United States Patent
Principe

(10) Patent No.: US 6,906,627 B1
(45) Date of Patent: Jun. 14, 2005

(54) FOOT POSITION TRAINING DEVICE

(76) Inventor: David L. Principe, 159 White Cedar Dr., East Amherst, NY (US) 14051

( * ) Notice: Subject to any disclaimer, the term of this patent is extended or adjusted under 35 U.S.C. 154(b) by 41 days.

(21) Appl. No.: 10/614,994

(22) Filed: Jul. 8, 2003

(51) Int. Cl.[7] ..... G08B 13/18

(52) U.S. Cl. ..... 340/556; 73/865.4; 473/218; 473/270

(58) Field of Search ..... 340/555, 556, 340/557; 73/1.79, 865.4; D21/780, 792; 473/270, 218, 225

(56) References Cited

U.S. PATENT DOCUMENTS 6,261,189 B1 * 7/2001 Saville et al. ..... 473/221
6,396,041 B1 * 5/2002 Vock et al. ..... 250/206.2

* cited by examiner

*Primary Examiner*—Jeffery Hofsass
*Assistant Examiner*—Jennifer Stone

(57) ABSTRACT

A foot positioning training device with a mat having a transmitter and receiver to establish an electric eye. The electric eye is tied to an alarm that indicates when a batter has taken an improper stride while swinging the bat.

9 Claims, 3 Drawing Sheets

FOOT POSITION TRAINING DEVICE

FIELD OF INVENTION

The present invention relates to sports training devices and specifically to a foot position training device suitable for baseball or fast pitch softball.

BACKGROUND OF THE INVENTION

Children begin learning how to bat a ball almost as soon as they are able to hold a bat. In fact, children begin learning to play the game of baseball as early as kindergarten, usually by hitting a ball off a tee (Tee Ball). Teaching proper hitting technique, including batting stance, is important at a young age as bad habits may be difficult to correct. A significant problem with young batters is their tendency to move their front foot away from the plate while swinging a bat. The problem is referred to as "bailing out" or "stepping in a bucket." If the stride is away from the plate, the batter's plate coverage is lost and it is very difficult to make contact with the pitched ball.

Accordingly, there is a need for a training device that addresses this problem.

SUMMARY OF THE INVENTION

The present invention meets the above-described need by providing a foot position training device that provides a visual or audible alarm when the front foot of a batter moves too far away from the plate during the batting stride.

BRIEF DESCRIPTION OF THE DRAWINGS

The invention is illustrated in the drawings in which like reference characters designate the same or similar parts throughout the figures of which.

DETAILED DESCRIPTION

Figure 1:
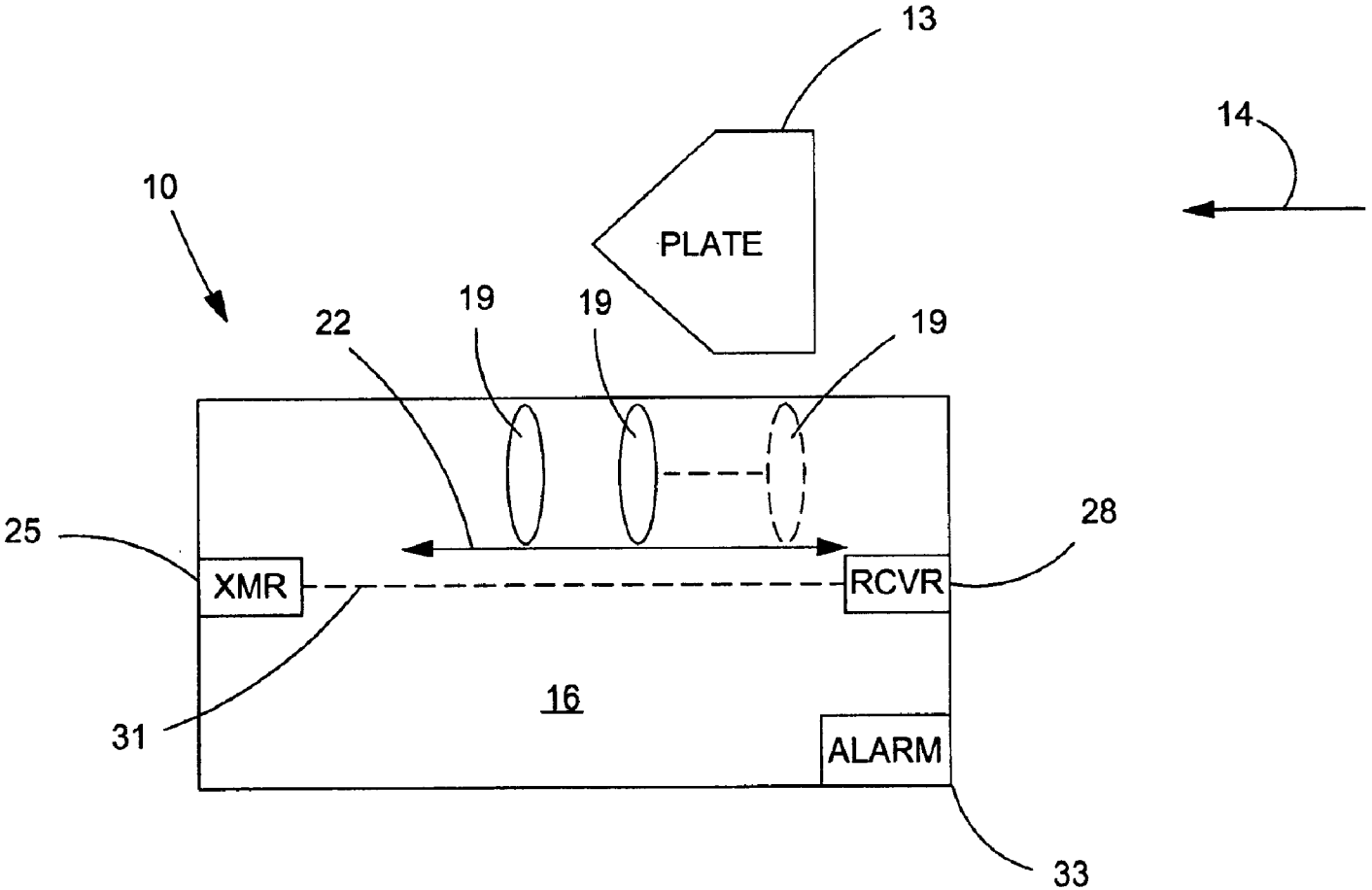
FIG. 1 is a plan view of the device of the present invention.

In FIG. 1, a foot position training device 10 is shown in position next to a standard home plate 13 for use in batting practice for baseball or fast pitch softball. The device is shown in position for a left handed batter. In order for use by a right handed batter the device is simply rotated 180 degrees, and moved to the other side of the plate. Typically, a pitching machine (not shown) will deliver balls across the plate 13 from right to left in the direction of arrow 14 to simulate live pitching. The batter typically hits off of the machine in batting practices where each batter takes turns hitting a succession of ten to twenty balls delivered to the plate 13 by the machine.

The device 10 includes a substantially planar mat 16 for the batter to stand on. The mat 16 is provided with indicia such as foot diagrams 19 as shown. Other types of indicia such as lines may also be provided. During the batting stroke, the back foot of the batter should remain in the same position except for pivoting. With respect to a horizontal axis 22 which is determined by the original position of the batter's feet in the relaxed state, the movement of the front foot of the batter should be in a plane either parallel to the back foot as shown in broken lines in the diagram or inward toward the plate 13.

An electric eye is established behind the feet of the batter such that a transmitter 25 and receiver 28 are aligned to transmit a beam 31 extending approximately parallel to axis 22. If the batter moves his or her front foot too far away from the plate 13, the beam 31 is broken and an alarm 33 is triggered by the device 10.

Figure 2:
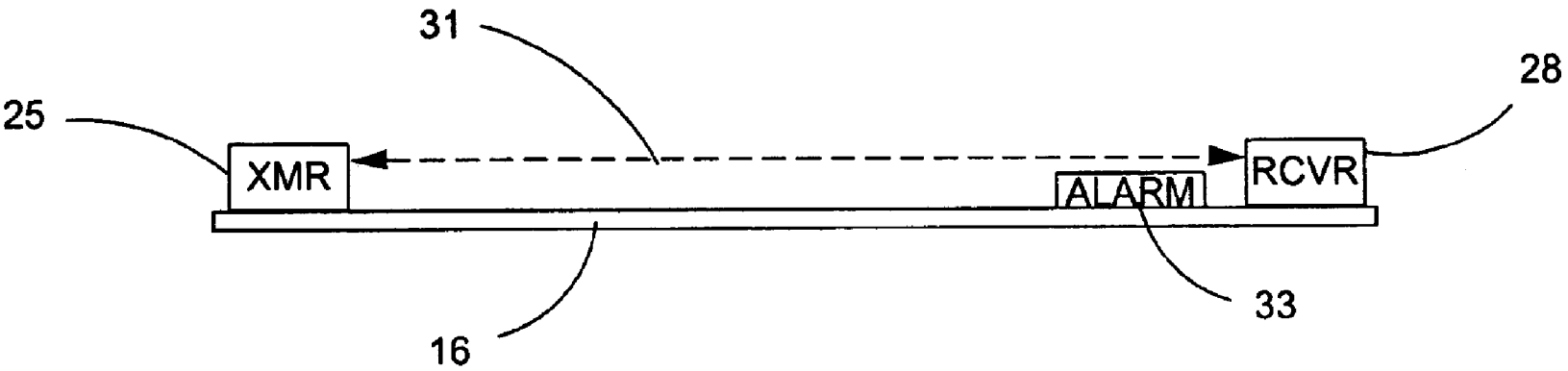
FIG. 2 is a side elevation view of the device.

As shown in FIG. 2, the transmitter 25 and receiver 28 may not have to be positioned very high above the mat 16. Because the device 10 is primarily intended for batting practice, the profile of the transmitter 25 and receiver 28 is not critical. Accordingly, the height of the transmitter 25 and receiver 28 may be adjusted. If the beam 31 is lower it may detect the foot of the batter, and if it is positioned higher it may detect the leg of the batter when the stride is too far from the plate 13. Also, the mat 16 can be made of suitable materials such as plastic, rubber, or the like in varying sizes with regard to width, length and thickness.

Figure 3:
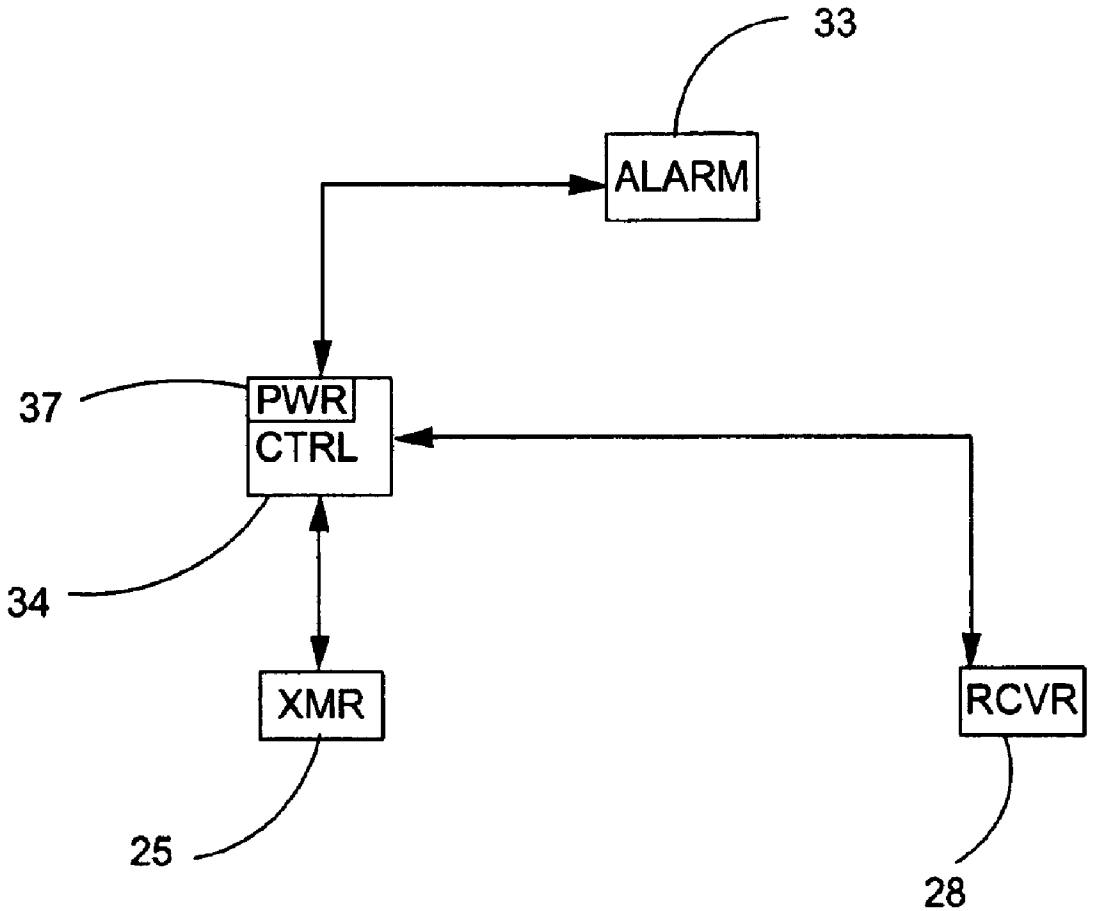
FIG. 3 is a block diagram of the control system for the present invention.

Turning to FIG. 3, the device 10 includes a control system 34 having a power supply 37. The power supply 37 is a battery, however, other power supplies including, but not limited to, a 110 V AC power supply may also be utilized. The control system 34 controls the transmitter 25 and receiver 28 and receives input if the beam 31 is broken. If the beam 31 is broken, the system 34 activates the alarm 33. The alarm 33 may be either audible or visual or both. The audible alarm includes, but is not limited to, a beep, a buzzer, or a pre-recorded message. The visual alarm includes but is not limited to, a light or beacon alarm. Other types of alarms capable of alerting the batter or batting instructor that the beam 31 has been broken would also be suitable.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A foot position training device, comprising:

a mat for supporting a person while swinging at a ball;

a transmitter disposed on the mat;

a receiver disposed on the mat in spaced apart relation to the transmitter, the receiver capable of receiving a beam from the transmitter to establish an electric eye;

an alarm responsive to interruption of the beam by the foot or leg of the person.

2. The foot positioning training device of claim 1, wherein the mat further comprises indicia related to the proper positioning of the person's feet during his or her batting stride.

3. The foot positioning training device of claim 1 wherein the alarm is audible.

4. The foot positioning system of claim 1, further comprising a battery-powered control system.

5. A foot positioning training device, comprising:

a mat having indicia relating to foot positioning of a person swinging at a pitched ball;

a transmitter disposed on the mat;

a receiver disposed on the mat in spaced apart relation from the transmitter such that the receiver is capable of receiving a beam from the transmitter to establish an electric eye; and, an alarm responsive to interruption of the beam by the foot or leg of the person.

6. A method of training proper foot positioning for a person while swinging at a pitched ball, comprising:

providing a transmitter;

providing a receiver aligned with the transmitter such that the receiver is capable of receiving a beam from the transmitter to establish an electric eye;

orienting the transmitter and receiver behind the feet of the person to establish a zone of allowable foot movement;

triggering an alarm when the beam is broken to indicate that an errant foot movement has occurred during the person's swing.

7. The method according to claim 6, comprising the further steps of:

providing a mat;

attaching the transmitter and receiver to the mat.

8. The method according to claim 7, comprising the further steps of:

providing written indicia on the mat for the person to use to align his or her feet.

9. The method according to claim 7 comprising the further steps of:

activating an audible alarm when the person swings incorrectly.

* * * * *